US007194983B2

(12) United States Patent
Kokko

(10) Patent No.: US 7,194,983 B2
(45) Date of Patent: Mar. 27, 2007

(54) CIRCULATING FLUIDIZED BED BOILER

(75) Inventor: Ari Kokko, Tampere (FI)

(73) Assignee: Kvaerner Power Oy, Tampere (FI)

( * ) Notice: Subject to any disclaimer, the term of this patent is extended or adjusted under 35 U.S.C. 154(b) by 0 days.

(21) Appl. No.: 11/171,322

(22) Filed: Jul. 1, 2005

(65) Prior Publication Data

US 2006/0000425 A1 Jan. 5, 2006

(30) Foreign Application Priority Data

Jul. 1, 2004 (FI) ..... 20040921

(51) Int. Cl.
*F23C 10/01* (2006.01)

(52) U.S. Cl. ..... 122/4 D; 165/104.16; 110/245

(58) Field of Classification Search ..... 122/4 D; 110/245; 165/104.16
See application file for complete search history.

(56) References Cited

U.S. PATENT DOCUMENTS

| | | | | |
|---|---|---|---|---|
| 4,813,479 A | | 3/1989 | Wahlgren | |
| 5,141,708 A | * | 8/1992 | Campbell et al. | 422/142 |
| 5,184,671 A | | 2/1993 | Alliston et al. | |
| 5,239,946 A | * | 8/1993 | Garcia-Mallol | 122/4 D |
| 5,341,766 A | * | 8/1994 | Hyppanen | 122/4 D |
| 5,463,968 A | | 11/1995 | Abdulally | |
| 5,601,039 A | * | 2/1997 | Hyppanen | 110/245 |
| 5,682,828 A | * | 11/1997 | Phalen et al. | 110/245 |
| 5,772,969 A | | 6/1998 | Hyppanen | |
| 6,237,541 B1 | | 5/2001 | Alliston et al. | |
| 6,631,698 B1 | * | 10/2003 | Hyppanen et al. | 122/4 D |
| 2005/0064357 A1 | * | 3/2005 | Watanabe | 432/14 |

FOREIGN PATENT DOCUMENTS

| | | |
|---|---|---|
| EP | 0518482 B1 | 7/1997 |
| JP | 05-322632 A | 7/1995 |
| JP | 11-121579 A | 11/2000 |

* cited by examiner

*Primary Examiner*—Gregory Wilson
(74) *Attorney, Agent, or Firm*—Venable LLP; Eric J. Franklin

(57) ABSTRACT

A circulating fluidized bed boiler including a furnace, a separator which is connected to the furnace to separate fluidized bed material from a flow leaving the furnace, as well as a return duct between the separator and the furnace to return the separated fluidized bed material into the furnace. The return duct includes a loop seal equipped with a heat exchanger and a supply of fluidizing medium and having an inlet and an outlet, which open into a chamber including the heat exchanger, i.e. a heat exchanger chamber, and are situated at different heights, the outlet being connected through a return conduit to the furnace. The flow cross-section area of the outlet is at an angle to the flow cross-section area of the inlet in such a way that the fluidized bed material is transferred in the heat exchanger chamber in lateral direction with respect to the inlet direction of its inlet flow. The heat exchanger chamber includes individually controllable fluidizing means at different locations in the direction of the horizontal dimension of the flow cross-section area of the outlet.

18 Claims, 7 Drawing Sheets

CIRCULATING FLUIDIZED BED BOILER

FIELD OF THE INVENTION

The invention relates to a circulating fluidized bed boiler.

BACKGROUND OF THE INVENTION

The operating principle of the circulating fluidized bed boiler is to circulate fluidized bed material in such a way that it is separated from flue gases by a cyclone and is returned via a return duct back to the furnace of the boiler. In the return duct, a loop seal is generally used, which can also be called a sand seal. An example of such a boiler is presented in U.S. Pat. No. 6,237,541 to Alliston et al. This boiler also comprises a heat exchanger chamber which is placed in the furnace and through which the hot fluidized bed material from the loop seal passes before it enters the actual fluidized bed inside the furnace. It is also well known to place the heat exchanger chamber in the actual loop seal and to provide the chamber with a fluidizing air supply, as presented in U.S. Pat. No. 4,813,479; EP patent 518 482; U.S. Pat. No. 5,184,671, and U.S. Pat. No. 5,463,968. It is the latter alternative that the present invention relates to, namely a loop seal separated from the furnace and equipped with a heat exchanger chamber.

A problem with boilers of prior art comprising such a loop seal is that the operation of the heat exchanger is not controllable.

For example, in the structure of U.S. Pat. 5,184,671, the fluidized bed material may travel from the inlet conduit through a heat exchanger chamber and an alternative route through a second chamber with no heat exchanger. The operation of the heat exchanger can be adjusted by guiding a part of the material via the second chamber by selecting the fluidizing velocities of both chambers in a suitable ratio.

SUMMARY OF THE INVENTION

The aim of the invention is to present a circulating fluidized bed boiler in which the passage of solid fluidized bed material and the heat exchange can be controlled in a way better than before, also at the loop seal, without a need to provide a separate by-pass chamber.

The fluidized bed material flowing in the external circulation and consisting of solid particles can be controlled by arranging the fluidization to be adjusted individually in areas or zones, at least in the width direction of the outlet. The zones or other fluidized bed material supply areas adjustable individually are thus placed at least sequentially one after the other in the inlet direction of the fluidized bed material, i.e. in the direction in which the material flow from the inlet enters the heat exchanger chamber. The minimum number of the separate zones is two.

Because the exit direction of the fluidized bed material is at an angle to the inlet direction, the material is brought into a lateral movement while it passes through the heat exchanger chamber. This lateral movement can be adjusted by varying the supply of the fluidized bed material in the inlet direction of the material. The supply can be reduced or even stopped, starting from the zone/area farthest away (seen in the inlet direction).

By means of the invention, the external heat exchanger of the circulating fluidized bed boiler can be made controllable without substantially affecting the permeability of the loop seal to the material. The control range may be from 50 to 100%. The structure which makes the controlled flow-through of the fluidized bed material possible can be easily integrated in the loop seal without extra supporting structures. The structure is also simple.

The invention comprises several embodiments. The inlet and the outlet of the heat exchanger chamber are at different height positions. The inlet may be situated lower than the outlet. Such an inlet may be, for example, in the lower part of the common wall of a dipleg and the heat exchanger chamber. The outlet is thus in the upper part of a wall that is at an angle to said wall. Alternatively, the inlet of the heat exchanger chamber may also be situated higher than the outlet. In this case, the inlet may be in the upper part of the common wall of an intermediate chamber following the dipleg and the heat exchanger chamber, and the outlet is in the lower part of a wall that is at an angle to said wall in the heat exchanger chamber. The intermediate chamber, which is between the dipleg and the heat exchanger chamber in the material flow direction, constitutes an extra loop seal in such a way that its inlet is situated lower than its outlet, which forms the inlet for the heat exchanger chamber.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
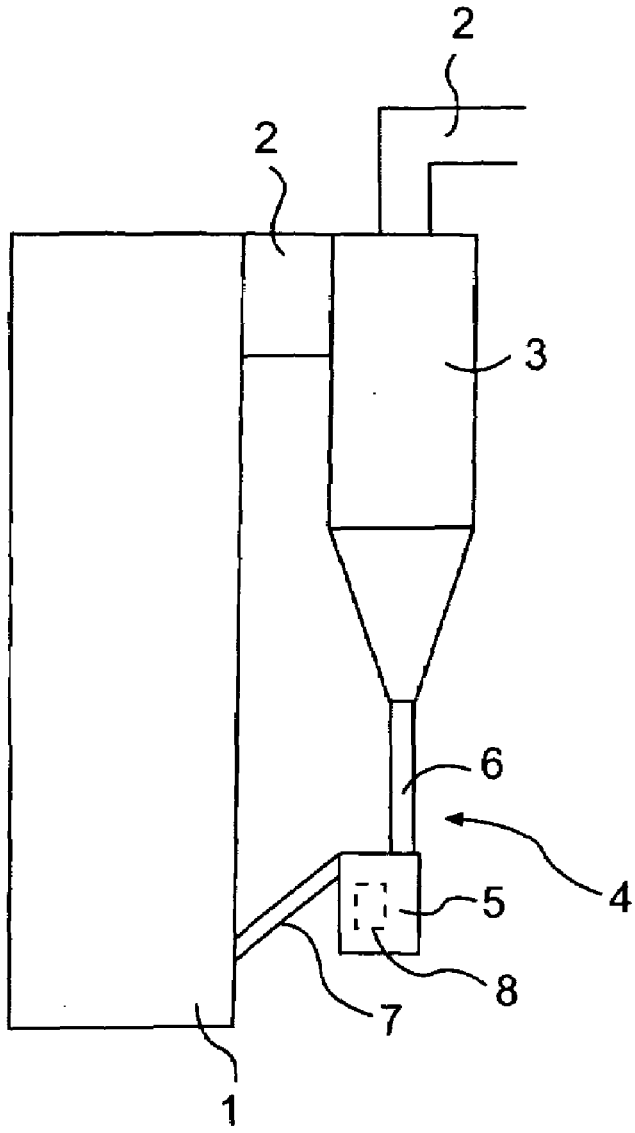
FIG. 1 shows a circulating fluidized bed boiler in a schematic view.

FIG. 1 shows a typical circulating fluidized bed boiler in which the material forms a so-called circulating fluidized bed (CFB). The boiler comprises a furnace 1, a flue 2 exiting the furnace, and a cyclone placed in the flue and used as a separator 3, which separates the fluidized bed material consisting of solid particles and passing in the flue and returns it to the furnace 1 via a return duct 4. The fluidized bed material may be, for example, inert particulate material, such as sand or crushed rock type, for example diabase. The return duct comprises a loop seal 5. The material travels from the separator 3 into the loop seal 5 via a standpipe or dipleg 6, whose lower end constitutes a so-called down-leg for the loop seal, and it returns from the loop seal 5 into the furnace along a downwardly inclined return conduit 7. The return duct 4 thus consists of the dipleg 6, the loop seal 5 and the return conduit 7. The furnace 1 is used for burning a fuel to produce heat, which is used for generating steam by methods known as such. The supply of fuel, fluidizing air and combustion air into the furnace as well as the elements relating to the generation of steam are not presented, as they are irrelevant to the invention.

In a way known as such, the loop seal 5 is equipped with a heat exchanger 8, whose structure and placement will be described in more detail hereinbelow. The lower part of the loop seal 5 is equipped with a supply 9 of fluidizing medium.

Figure 2A:
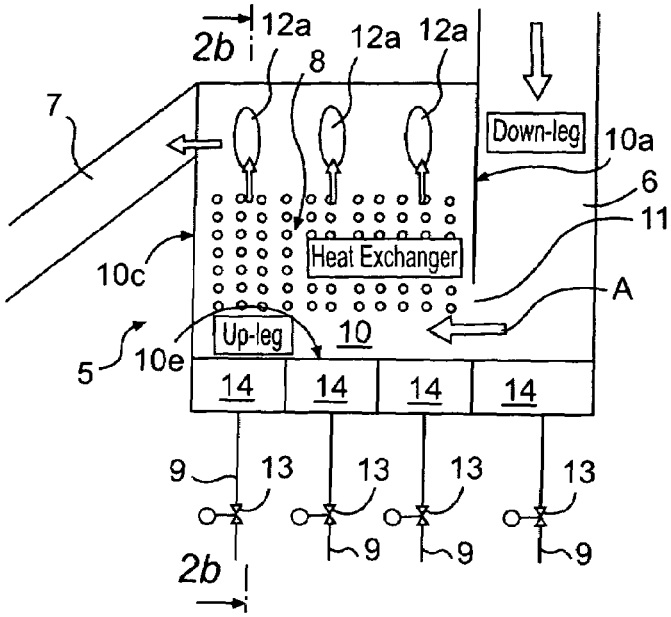
FIGS. 2*a–c* show the first embodiment of the controllable external heat exchanger in side, front and top views.
Figure 2B:
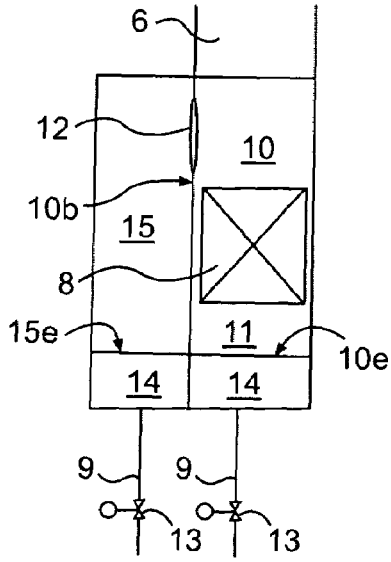
Figure 2C:
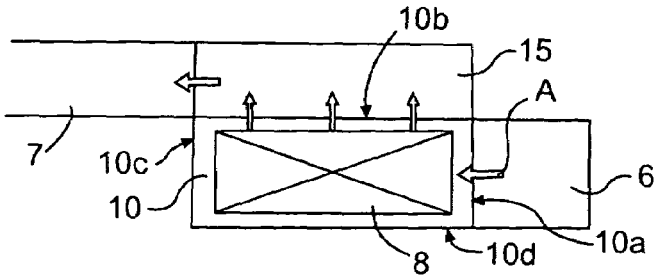

FIG. 2 show a first embodiment of the loop seal 5 in a side view (a), a front view (b) and a top view (c). In connection with other figures, the same letters will be used for the side, front and top views. The heat exchanger 8 is placed in a heat exchanger chamber 10, and it consists of pipes or the like, which extend through the volume of the chamber and in which flows a medium to which heat is transferred through the chamber 10 from the hot fluidized bed material moving in a way to be described below. The dipleg 6 ends behind the heat exchanger chamber 10. The rear wall 10*a* of the heat exchanger chamber forms at the same time one wall of the dipleg, and it ends at a short distance from the bottom 10*e* of the chamber 10 in such a way that an inlet 11 for the fluidized bed material is formed between the bottom 10*e* and the lower edge of the wall 10*a*. The inlet of the fluidized bed material via this inlet 11 into the heat exchanger chamber 10 is indicated with an arrow A. The heat exchanger chamber 10 forms a so-called up-leg for the loop seal 5. An outlet 12 is provided in the second wall 10*b* of the chamber 10. The outlet 12 is placed higher than the inlet 11, and in the figure it consists of three openings 12*a* side-by-side. The openings 12*a* are at different locations in the inlet direction of the material (arrow A), and the flow cross-section area formed by them is at an angle to the flow cross-section area of the inlet 11. FIG. 2*c* shows that the wall 10*a* comprising the inlet 11 connects at an angle to the wall 10*b* comprising the outlet 12. As is best shown in FIG. 2*a*, the inlet 11 is in the lower part of the rear wall 10*a* of the heat exchanger chamber 10, and the outlet 12, in turn, is in the upper part of the chamber side wall 10*b* that is at an angle of 90° C. to the rear wall. In this way, the passage of the material is simultaneously provided with a lateral displacement when it travels upwards in the heat exchanger chamber 10 by the effect of the fluidizing medium.

The inlet direction of the material (arrow A) and the exit direction of the material into the return conduit 7 run in different lines towards the furnace, and a side wall 10*b* is provided between the lines, through which side wall the material passes in the lateral direction.

FIG. 2 shows how the bottom 10*e* of the heat exchanger chamber 10 is divided in the inlet direction (arrow A) of the material into fluidization zones or areas 14 which are individually adjustable with control means, such as valves 13. The control means can be used independently of each other to control the supply of fluidizing air. A fluidization zone 14 to be adjusted individually with a control means (valve 13) is also directly underneath the dipleg 6. These fluidization zones 14 can be further divided, in a direction perpendicular to the inlet direction (arrow A), into subzones which can be controlled separately from each other. However, it is essential that there are zones 14 at least one after the other in the inlet direction A of the material in the fluidization area.

Adjacent to the heat exchanger chamber 10, on the other side of the outlet 12, an outlet chamber 15 is provided, whose bottom 15*e* is, in the embodiment of FIG. 2, at the same level with the bottom 10*e* of the heat exchanger chamber. A return conduit 7 extends diagonally downwards from the upper part of this outlet chamber towards the furnace. The return conduit connects the loop seal 5 with the furnace. In this case, the loop seal has no wall in common with the furnace. The bottom 15*e* of the outlet chamber 15 is also equipped with a fluidizing air supply which can be adjusted individually independently of fluidizing air supply areas or zones 14 of the heat exchanger chamber 10 (valve 13). The outlet chamber 15 and the heat exchanger chamber 10 are separated from each other by said side wall 10*b* shared by the chambers. The fluidized bed material, which has delivered heat in the heat exchanger chamber 10, passes through the outlet 12 into the outlet chamber 15, from which it enters the return conduit 7.

As seen from FIG. 2*c*, the heat exchanger chamber 10 has a rectangular horizontal cross section in such a way that the inlet direction (arrow A) of the fluidized bed material is parallel to the longer sides. The rear wall 10*a* and the front wall 10*c* of the chamber thus constitute the shorter sides, and the side walls 10*b* and 10*d*, of which one comprises the outlet 12, constitute the longer sides. Naturally, the heat exchanger chamber 10 as well as the outlet chamber 15 are also closed at the top.

Heat transfer in the chamber 10 can be controlled by adjusting the fluidization through the bottom 10*e* zonewise. If necessary, the fluidization can be reduced, starting from the area 14 farthest away from the inlet 11, i.e. on the side of the front wall 10*c*. The fluidization can also be stopped completely at this point. In this way, it is possible to reduce the heat transfer from the fluidized bed material into the heat exchanger, if necessary. Consequently, the heat transfer is adjusted by controlling the passage of the material in the same chamber, and no particular by-pass chambers will be needed.

Fluidization by areas or zones through the bottom 10*e* of the heat exchanger chamber 10 can be implemented structurally by providing the windbox underneath with a sufficient number of partition walls and by providing each compartment, limited by the partition walls and defining the location of the fluidization zone 14, with a separate pipe 9 for supplying fluidizing air, equipped with a controllable valve 13.

As seen in FIG. 2*a*, the bottom 15*e* of the outlet chamber 15 is on the same level as the bottom 10*e* of the heat exchanger chamber 10. For supplying fluidizing air into the outlet chamber 15 individually independently of the supply of fluidizing air into the heat exchanger chamber 10, a compartment is provided underneath the bottom of the outlet chamber. This compartment is separated from the fluidization compartments of the heat exchanger chamber 10, to form a separate fluidized bed zone 14. As best shown in FIG. 2*a*, the exit opening of fluidizing air from the outlet chamber 15, i.e. the exit opening of the return conduit 7, is in the upper part of the front wall of the outlet chamber.

Figure 3A:
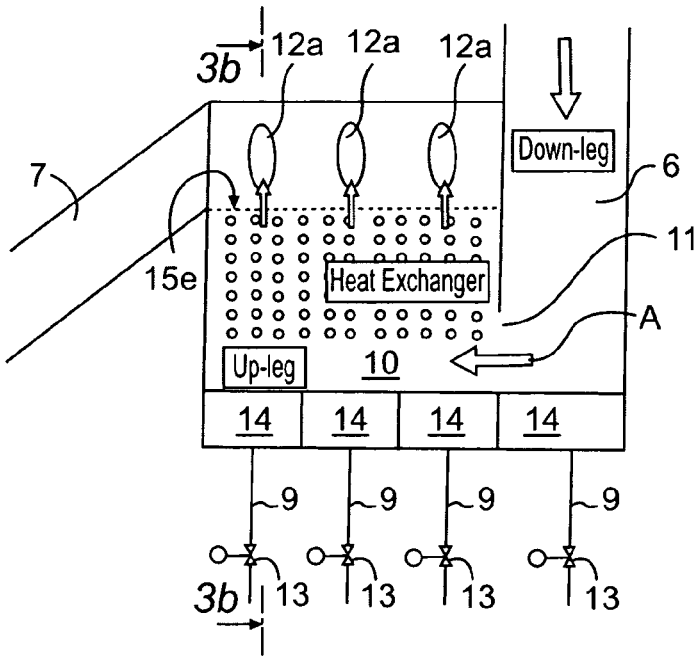
FIGS. 3*a–c* show a second embodiment in side, front and top views.
Figure 3B:
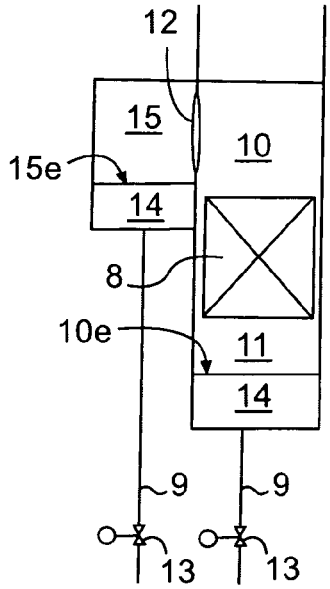
Figure 3C:
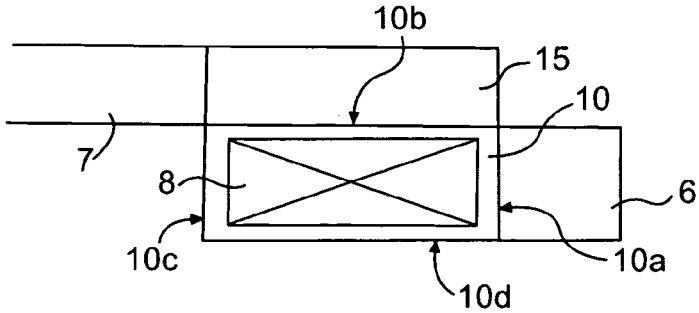

FIG. 3 show a second structural alternative in which the movements of the fluidized bed material through the heat exchanger chamber 10 and the zonewise supply of fluidizing air from below into the chamber 10 is arranged according to the same principle as in FIG. 2. However, the structure here is such that the bottom 15*e* of the outlet chamber 15 is situated higher than the bottom 10*e* of the heat exchanger chamber, and the lower edge of the exit opening is at the height of the bottom 15*e*. This structure has the advantage of a smaller solid matter load.

Figure 4A:
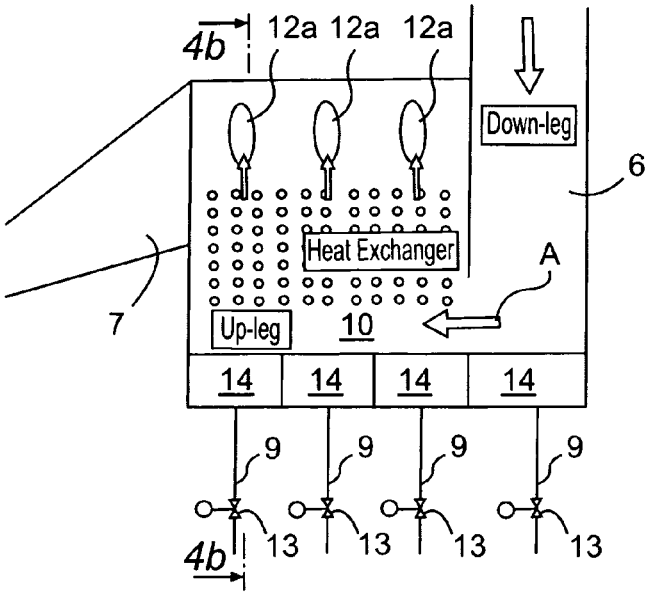
FIGS. 4*a–c* show a third embodiment in side, front and top views, FIGS. 5*a, b*1, *b*2 show a fourth embodiment in top, rear and side views.
Figure 4B:
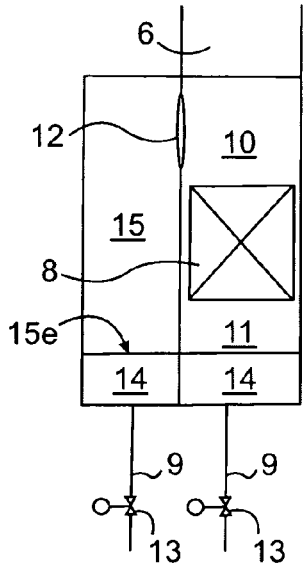
Figure 4C:
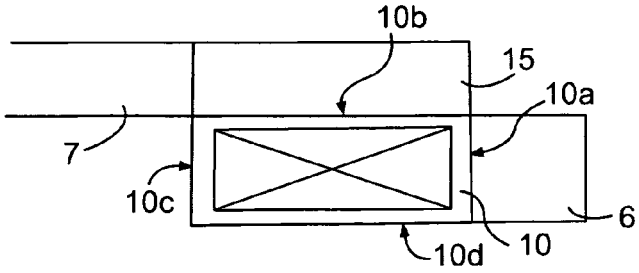

FIG. 4 shows a structure whose operating principle corresponds to that of FIGS. 2 and 3. In the structure the outlet chamber 15 is, again, in the same position as the heat exchanger chamber 10 in the height direction, but the lower edge of the exit opening of the return conduit 7, i.e. the threshold, is at a lower position than in FIG. 1. The advantage here is a smaller solid matter load while the structure remains simple.

FIG. 5 shows, in a side view (a), two rear views (b1, b2) and a top view (c), a structure in which the heat exchanger chamber comprises an inlet 11 and an outlet 12 at different height positions. In the heat exchanger chamber 10, the material is transferred in the horizontal direction by the same principle as above, that is, into the outlet laterally in view of the inlet direction A. There are also fluidizing means (fluidization zones 14 and respective valves 13) at different locations in the horizontal dimension of the outlet 12. Between the lower end of the dipleg 6 from the separator, and the heat exchanger chamber 10, in relation to the material flow direction, there is an intermediate chamber 16 used as an extra loop seal, with the inlet and the outlet at different heights. A lower inlet 17 from the dipleg 6, as well as an upper outlet, which simultaneously forms the inlet 11 for the heat exchanger chamber 10, open into the intermediate chamber. The inlet 11 of the heat exchanger chamber 10 is thus situated higher than its outlet 12. The bottom 16*e*of the intermediate chamber 16 is also equipped with a separate supply of fluidizing air (fluidization zone 14, supply pipe 9 for the fluidizing air, and adjustable valve 13 therein). The lower end of the dipleg 6 is equipped with a supply of fluidizing air similar to that in the embodiment of FIGS. 2 to 4 above.

The intermediate chamber 16, the heat exchanger chamber 10 and the outlet chamber 15 following the heat exchanger chamber 10 thus constitute a so-called double loop seal so that the main flow direction of the material is upwards in the intermediate chamber 16, forming the up-leg, and downwards in the heat exchanger chamber 10. A second up-leg is formed in the outlet chamber 15 following the heat exchanger chamber 10, because the outlet 12 (inlet for the outlet chamber 15) is located lower than the exit opening into the return conduit 7. The lower edge of the exit opening of the return conduit 7 is thus placed higher than the inlet into the outlet chamber 15. With respect to the height position of the exit opening and the location of the bottom 15*e* of the outlet chamber, the structure is the same as in FIGS. 2*a* and 2*b*.

Thanks to the double loop seal or double lock arrangement, a seal is also formed on the furnace side of the heat exchanger chamber 10. In this way, it is also possible to minimize the passage of gases into the heat exchanger. Because the solid material passes downwards in the heat exchanger chamber 10, the heat exchanger chamber can be driven at a low fluidizing velocity.

Figure 5A:
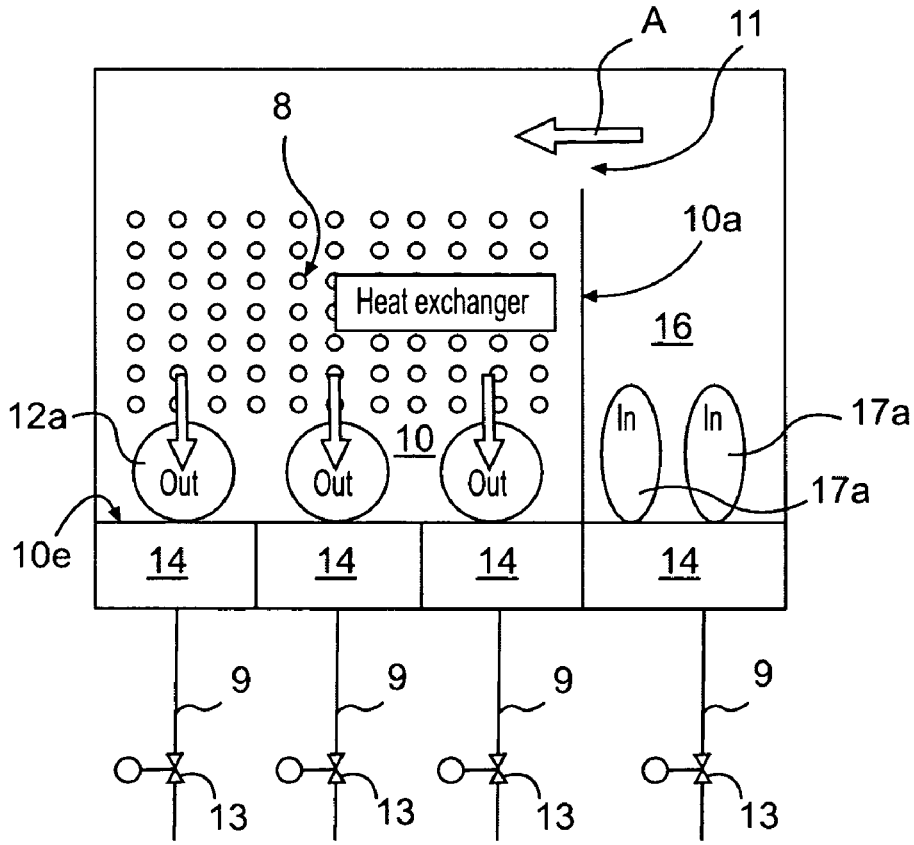

In the lower part of the wall 16*b* common to the intermediate chamber 16 and the dipleg 6, an inlet 17 is formed by two openings 17*a* next to each other in the wall. The number of these openings may also be different. The inlet 17 can also be formed in such a way that the wall 16*b* ends at a short distance from the bottom 16*e*of the intermediate chamber 16 so that the inlet is formed between the bottom and the lower edge of the wall. FIG. 5*b*1, which is a rear view of the structure in the section A—A, shows, in a corresponding manner, how the outlet of the intermediate chamber 16 (inlet 11 of the heat exchanger chamber 10) is formed as a rectangular opening in the upper part of the wall 10*b* common to the intermediate chamber 16 and the heat exchanger chamber 10. The outlet can also be formed so that the wall 10*a* ends before the top closing the heat exchanger chamber 10 and the intermediate chamber 16 from above, wherein the outlet is formed between the upper edge of the wall 10*a* and the top.

Figure 5C:
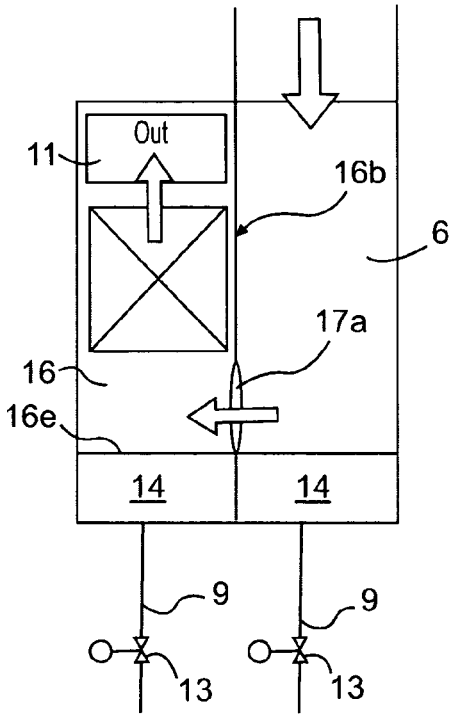
Figure 5C:
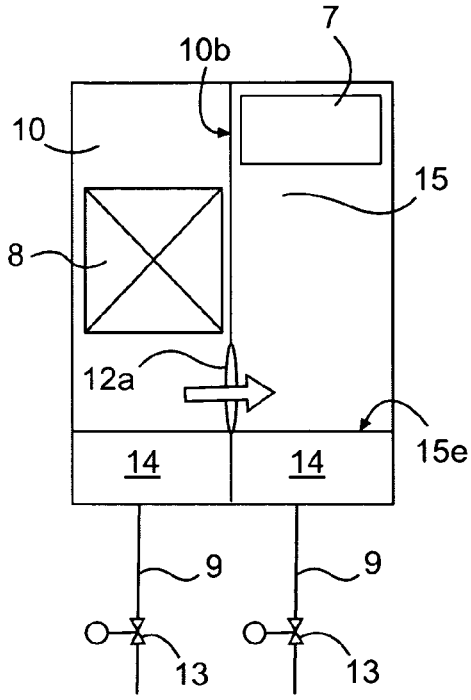
Figure 5C:
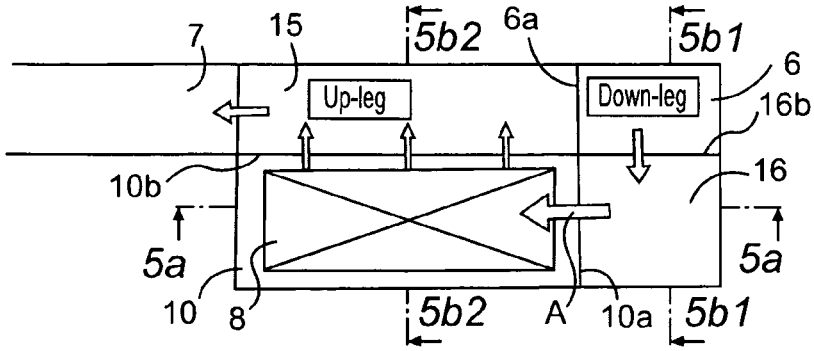

Structurally, the double loop seal can be constructed to be compact. FIG. 5*c* shows how the heat exchanger chamber 10 and the intermediate chamber 16 forming the extra loop seal are arrayed one after the other. The outlet chamber 15, from which the return conduit 7 exits, and the lower part of the dipleg 6 are arrayed one after the other next to the heat exchanger chamber 10 and the intermediate chamber 16. In a horizontal cross-section, the material thus travels so that between the dipleg 6 and the intermediate chamber 16 (through the inlet 17), the material travels at an angle to the direction A (inlet direction into the heat exchanger chamber 10), and between the heat exchanger chamber 10 and the outlet chamber 15 (through the outlet 12), the material travels in the opposite direction with respect to the travel through the inlet 17.

In the embodiment of FIG. 5, it is also possible to provide a pressure relief opening to vent fluidizing air in the upper part of the wall 16*b* between the lower part of the dipleg 6 and the intermediate chamber 16. An alternative location for the pressure relief opening is the upper part of the wall 10*b* between the chambers 10 and 15.

The outlet chamber 15, the heat exchanger chamber 10, the intermediate chamber 16, and the lower part of the dipleg 6 are arrayed in the horizontal direction to join each other so that they form a compact unit. The heat exchanger chamber 10 and the outlet chamber 15 have the wall 10*b* in common, the heat exchanger chamber 10 and the intermediate chamber 16 have the wall 10*a* in common, the intermediate chamber 16 and the lower part of the dipleg 6 have wall 16*b* in common, and the lower part of the dipleg 6 and the outlet chamber 15 have the wall 6*a* in common. The unit can be formed to have a rectangular external horizontal cross-section. The chambers limited by the walls can thus form a squared structure in the horizontal cross-section. As shown in FIG. 5*c*, the walls 10*b* and 16*b* are of the same wall, and the walls 10*a* and 6*a* are of the same wall extending at a right angle to the former. In the unit with a rectangular horizontal cross-section, the walls 10*b* and 16*b* and the walls 10*a* and 6*a* extend in the direction of the longer side and the shorter side of the rectangle, respectively.

Figure 6:
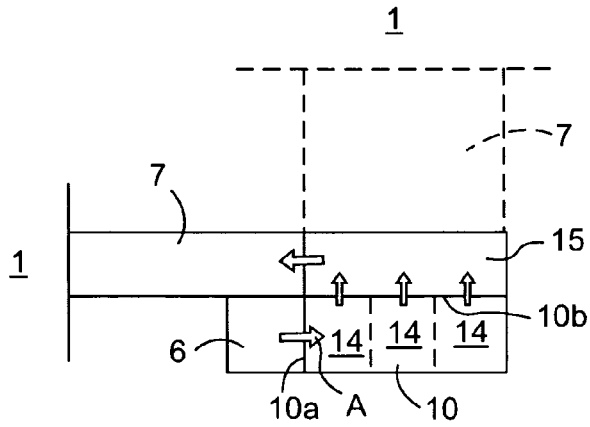
FIG. 6 shows a second embodiment with respect to the location of the chambers and the furnace.

FIG. 6 is a view in horizontal cross-section showing an alternative placement of the different chambers with respect to the furnace 1. This alternative has the advantage that the loop seal is constructed farther away from the boiler with respect to the dipleg 6. This may be advantageous, because on the other side of the dipleg there is normally more space available. This embodiment comprises the same chambers as in FIGS. 2 to 4, and inlets and outlets are placed between the chambers in a similar manner, but the dipleg 6 is now between the boiler and the heat exchanger chamber 10; that is, the heat exchanger chamber 10 is on the other side of the dipleg, seen from the boiler. At the bottom of the heat exchanger chamber 10, there are fluidization zones (indicated with broken lines) operating in the same way as in the preceding embodiment, but the inlet direction A of the material is away from the boiler. The outlet chamber 15 is in this case also placed so that the fluidized bed material flows in a lateral direction with respect to its inlet direction (arrow A), seen in a horizontal cross-section. The return conduit 7 extends adjacent to the dipleg 6 towards the furnace 1; in other words, the fluidized bed material flows here in a direction opposite to its inlet direction A into the heat exchanger chamber 10.

Consequently, the path of travel of the material in the horizontal cross-section is U-shaped between the dipleg 6 and the return conduit 7.

In the embodiment of FIG. 6, the structural alternatives of the outlet chamber 15 (location of the lower edge of the return conduit 7 and the bottom of the outlet chamber) may be the same as in FIGS. 2 to 4.

Furthermore, FIG. 6 shows, with broken lines, an alternative in which the dipleg 6 and the heat exchanger chamber are placed at an approximately equal distance from the furnace 1, next to each other, the outlet chamber 15 is placed on the side of the heat exchanger chamber 10 that is closer to the furnace 1, and the return conduit 7 exits towards the furnace from the longer side of the outlet chamber 15, wherein the outlet opening is on the longer side of this chamber 15 instead of the shorter side.

Figure 7:
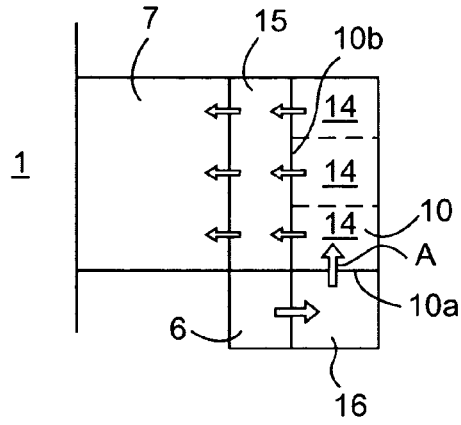
FIG. 7 shows a third embodiment with respect to the location of the chambers and the furnace.

FIG. 7 shows a double loop seal according to FIG. 5, but also in this case the chambers are arrayed on the other side of the dipleg 6 (intermediate chamber 16 and the heat exchanger chamber 10), and next to it (outlet chamber 15), seen from the furnace. The return conduit 7 exits from the longer side of the outlet chamber 15. The inlets and outlets between the chambers are placed in the height direction with respect to each other in the same way as in the embodiment of FIG. 5. Also this arrangement allows better utilization of the space on the other side of the dipleg 6.

Figure 8:
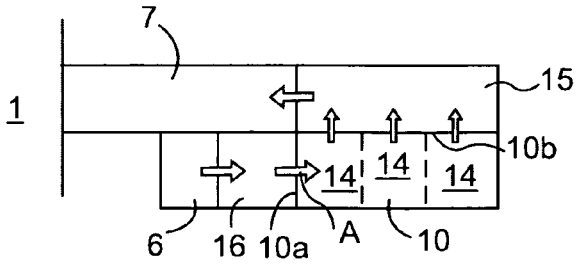
FIG. 8 shows a fourth embodiment with respect to the location of the chambers and the furnace.

FIG. 8 shows yet another placement of the chambers, which corresponds to the embodiment of FIG. 6 with respect to the mutual placement of the lower end of the dipleg 6, the heat exchanger chamber 10 and the outlet chamber 15, but between the lower end 6 of the dipleg and the heat exchanger chamber 10 there is the intermediate chamber 16 forming the extra loop seal; that is, the mutual height position of the inlets and outlets corresponds to the embodiment of FIG. 5. Different from the embodiment of FIG. 7, the material is transferred in the same direction between the lower end of the dipleg 6 and the heat exchanger chamber 10, seen in a horizontal cross-section, because the dipleg 6, the intermediate chamber 16 and the heat exchanger chamber 10 are aligned one after the other.

The invention is not restricted to the embodiments shown in the figures, but it can be varied within the scope of the inventive idea presented in the claims. The outlet 12 may also consist of openings with a shape different from the vertical oval openings 12*a* at regular intervals shown in FIGS. 2 to 5. The outlet 12 may also consist of only a single integral opening having a horizontal dimension. Furthermore, the term "inlet in a wall" or "outlet in a wall" should be understood to be both a single opening or several openings limited by the corresponding wall material, and an opening formed in the space limited by the edge of the corresponding wall material and the rest of the structure.

Moreover, the operation of the heat exchanger 8 is not limited. It can operate either as a steam generator or a superheater.

What is claimed is:

1. A circulating fluidized bed boiler, comprising a furnace, a separator connected to the furnace to separate fluidized bed material from a flow leaving the furnace, a return duct between the separator and the furnace to return the separated fluidized bed material into the furnace;

said return duct comprising a loop seal comprising a heat exchanger chamber comprising a heat exchanger, a bottom, walls and a closed top defining the chamber, a supply of fluidizing medium, an inlet and an outlet, which open into said heat exchanger chamber, and are situated at different heights, the outlet being connected through a return conduit to the furnace;

said inlet providing an inlet direction for an inlet flow of the fluidized bed material and a flow cross-section area for the fluidized bed material, and said outlet providing a flow cross-section area of a horizontal dimension for the fluidized bed material;

whereby the flow cross-section area of the outlet is at an angle to the flow cross-section area of the inlet in such a way that the fluidized bed material is transferred in the heat exchanger chamber in lateral direction with respect to the inlet direction of its inlet flow;

the heat exchanger chamber further comprising individually controllable fluidizing means at different locations in the direction of the horizontal dimension of the flow cross-section area of the outlet, and an outlet chamber arranged adjacent to the heat exchanger chamber, the outlet chamber comprising a bottom, wherein the return conduit exits from the outlet chamber, and wherein the outlet chamber is connected through said outlet to the chamber comprising the heat exchanger.

2. The boiler according to claim 1, wherein the inlet and the return conduit are in different lines, a wall comprising said outlet being provided between these lines.

3. The boiler according to claim 1, wherein the outlet chamber is also equipped with a supply of fluidizing medium.

4. The boiler according to claim 3, wherein the outlet chamber comprises an exit opening leading into the return conduit and having a lower edge which is situated higher than the bottom of the outlet chamber.

5. The boiler according to claim 1, wherein the outlet chamber comprises an exit opening leading into the return conduit and having a lower edge which is at the level of the bottom of the outlet chamber, which is situated higher than the bottom of the heat exchanger chamber.

6. The boiler according to claim 1, wherein the return conduit extends from the loop seal diagonally downwards into the furnace.

7. The boiler according to claim 1, wherein the chamber comprising the heat exchanger is a chamber having a substantially rectangular cross-section, having the inlet in its shorter wall and the outlet in its longer wall.

8. The boiler according to claim 1, wherein the outlet comprises openings at different locations in the direction of its horizontal dimension.

9. The boiler according to claim 1, wherein the outlet is situated higher than the inlet.

10. A circulating fluidized bed boiler, comprising a furnace, a separator connected to the furnace to separate fluidized bed material from a flow leaving the furnace, a return duct between the separator and the furnace to return the separated fluidized bed material into the furnace;

said return duct comprising a loop seal comprising a heat exchanger chamber comprising a heat exchanger, a bottom, walls and a closed top defining the chamber, a supply of fluidizing medium, an inlet and an outlet, which open into said heat exchanger chamber, the outlet being situated higher than the inlet and being connected through a return conduit to the furnace, wherein the inlet is in the lower part of a wall common to a dipleg from the separator and the heat exchanger chamber;

said inlet providing an inlet direction for an inlet flow of the fluidized bed material and a flow cross-section area for the fluidized bed material, and said outlet providing a flow cross-section area of a horizontal dimension for the fluidized bed material;

whereby the flow cross-section area of the outlet is at an angle to the flow cross-section area of the inlet in such a way that the fluidized bed material is transferred in the heat exchanger chamber in lateral direction with respect to the inlet direction of its inlet flow;

the heat exchanger chamber further comprising individually controllable fluidizing means at different locations in the direction of the horizontal dimension of the flow cross-section area of the outlet.

11. The boiler according to claim 10, wherein the heat exchanger chamber and the lower part of the dipleg are arrayed one after the other, and an outlet chamber, from which the return conduit exits, is placed next to the heat exchanger chamber.

12. A circulating fluidized bed boiler, comprising a furnace, a separator connected to the furnace to separate fluidized bed material from a flow leaving the furnace, a return duct between the separator and the furnace to return the separated fluidized bed material into the furnace;

said return duct comprising a loop seal comprising a heat exchanger chamber comprising a heat exchanger, a bottom, walls and a closed top defining the chamber, a supply of fluidizing medium, an inlet and an outlet, which open into said heat exchanger chamber, and are situated at different heights, the outlet being connected through a return conduit to the furnace, wherein the outlet is situated lower than the inlet, and an intermediate chamber serving as an extra loop seal between a dipleg from the separator and the heat exchanger chamber, the intermediate chamber comprising a lower inlet and an upper outlet, which simultaneously constitutes said inlet into the heat exchanger chamber;

said inlet providing an inlet direction for an inlet flow of the fluidized bed material and a flow cross-section area for the fluidized bed material, and said outlet providing a flow cross-section area of a horizontal dimension for the fluidized bed material;

whereby the flow cross-section area of the outlet is at an angle to the flow cross-section area of the inlet in such a way that the fluidized bed material is transferred in the heat exchanger chamber in lateral direction with respect to the inlet direction of its inlet flow;

the heat exchanger chamber further comprising individually controllable fluidizing means at different locations in the direction of the horizontal dimension of the flow cross-section area of the outlet.

13. The boiler according to claim 12, wherein the lower inlet is in the lower part of a wall common to the intermediate chamber and the dipleg.

14. The boiler according to claim 12, wherein the heat exchanger chamber and the intermediate chamber forming the extra loop seal are arrayed one after the other, and an outlet chamber, from which the return conduit exits, and the lower part of the dipleg are arrayed one after the other next to said heat exchanger chamber and said intermediate chamber.

15. The boiler according to claim 14, wherein the outlet chamber, from which the return conduit exits, the heat exchanger chamber, the intermediate chamber serving as the extra loop seal, and the lower part of the dipleg are arrayed in a horizontal cross-section to join to each other so that the heat exchanger chamber and the outlet chamber have a common wall, the heat exchanger chamber and the intermediate chamber have a common wall, the intermediate chamber and the lower part of the dipleg have a common wall, and the lower part of the dipleg and the outlet chamber have a common wall.

16. The boiler according to claim 15, wherein the outlet chamber, from which the return conduit exits, the heat exchanger chamber, the intermediate chamber serving as the extra loop seal, and the lower part of the dipleg constitute a rectangular structure in the horizontal cross-section.

17. The boiler according to claim 14, wherein at least one chamber of the loop seal is farther away from the furnace than the dipleg.

18. A circulating fluidized bed boiler, comprising a furnace, a separator connected to the furnace to separate fluidized bed material from a flow leaving the furnace, a return duct between the separator and the furnace to return the separated fluidized bed material into the furnace;

said return duct comprising a loop seal comprising a heat exchanger chamber comprising a heat exchanger, a bottom, walls and a closed top defining the chamber.

a supply of fluidizing medium.

an inlet and an outlet, which open into said heat exchanger chamber, and are situated at different heights, the outlet being connected through a return conduit to the furnace;

said inlet providing an inlet direction for an inlet flow of the fluidized bed material and a flow cross-section area for the fluidized bed material, and said outlet providing a flow cross-section area of a horizontal dimension for the fluidized bed material;

whereby the flow cross-section area of the outlet is at an angle to the flow cross-section area of the inlet in such a way that the fluidized bed material is transferred in the heat exchanger chamber in lateral direction with respect to the inlet direction of its inlet flow;

the heat exchanger chamber further comprising individually controllable fluidizing means at different locations in the direction of the horizontal dimension of the flow cross-section area of the outlet, wherein at least one chamber of the loop seal is farther away from the furnace than a dipleg from the separator.

* * * * *